United States Patent [19]

Yanari

[11] 4,196,905

[45] Apr. 8, 1980

[54] GAME APPARATUS

[76] Inventor: Frank F. Yanari, 2650 Jersey Ave., Minneapolis, Minn. 55426

[21] Appl. No.: 871,378

[22] Filed: Jan. 23, 1978

[51] Int. Cl.[2] ..... A63F 3/00

[52] U.S. Cl. ..... 273/271; 273/148 R; 273/288

[58] Field of Search ..... 273/260, 261, 264, 271, 273/272, 288, 148 R

[56] References Cited

U.S. PATENT DOCUMENTS

| | | | |
|---|---|---|---|
| 711,959 | 10/1902 | Graham | 273/261 X |
| 817,233 | 4/1906 | Emmerling | 273/260 |
| 1,051,718 | 1/1913 | Elvers | 273/261 |

FOREIGN PATENT DOCUMENTS

| | | | |
|---|---|---|---|
| 1107303 | 8/1955 | France | 273/272 |
| 16341 | of 1887 | United Kingdom | 273/264 |
| 800739 | 9/1958 | United Kingdom | 273/271 |

*Primary Examiner*—Anton O. Oechsle

*Attorney, Agent, or Firm*—Burd, Bartz & Gutenkauf

[57] ABSTRACT

A game involving the placing of checkers on a game board made up of 20 vertical columns and 20 horizontal files of squares in an attempt to align six or more checkers belonging to one team horizontally, vertically or diagonally is played by two opposing teams of two players per team. Each row of squares running diagonally in one direction is colored entirely in one of three separate colors. The squares making up the longests diagonal row appear in a neutral color, the squares in the next adjacent contiguous diagonal row on one side are colored pink and the squares on the next adjacent contiguous diagonal row on the other side of the neutral row are colored blue. The colors repeat and no two contiguous diagonal rows are the same color. Each team has 72 checkers colored either black or white to represent that team. Each checker has a spot on one side colored pink and a spot on the other side colored blue. Each player puts one checker on the board in turn. One of the players of each team places his checkers on the board with the pink spot uppermost while the other player must place his checkers with the blue spot uppermost. Pink spotted checkers cannot be placed on blue squares and blue spotted checkers cannot be placed on pink squares. Play proceeds in a clockwise or counterclockwise direction around the table until a player scores by placing the sixth or higher numbered checker in a straight line, at which time the direction of play reverses, and this is indicated by changing the position of a novel direction indicator. When a player scores, a counter indicating that score is placed on top of the scoring checker.

11 Claims, 9 Drawing Figures

FIG. 1
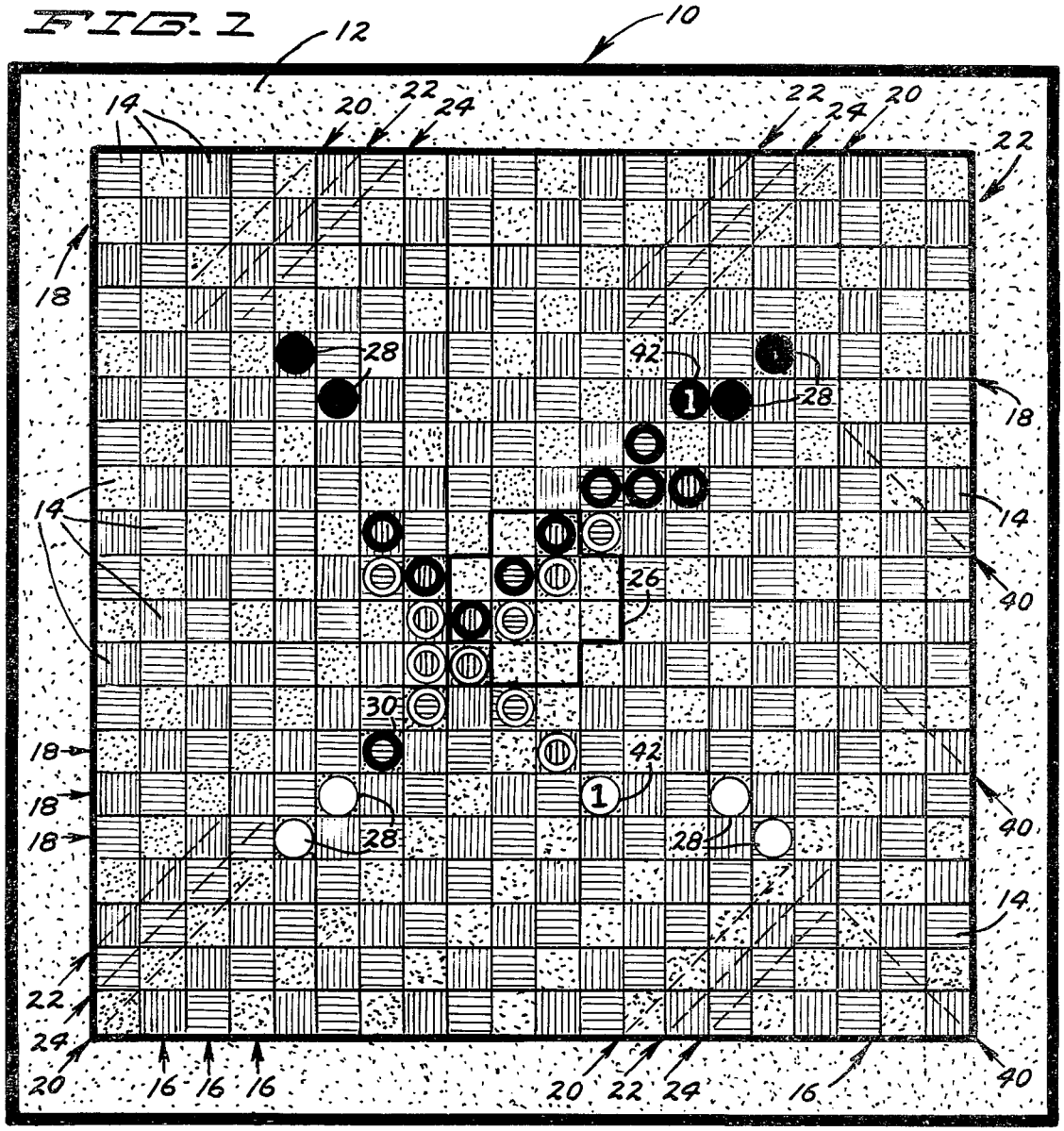
FIG. 2
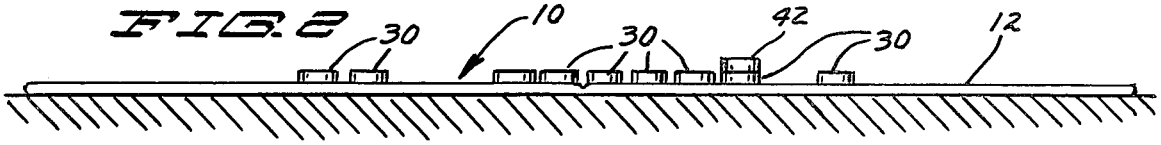
FIG. 3
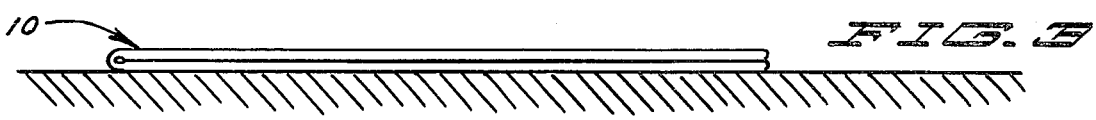
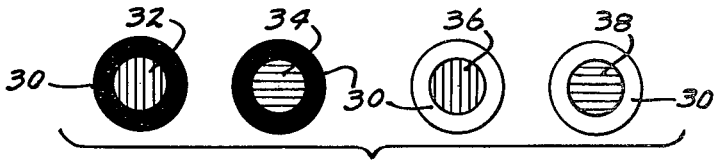
FIG. 4

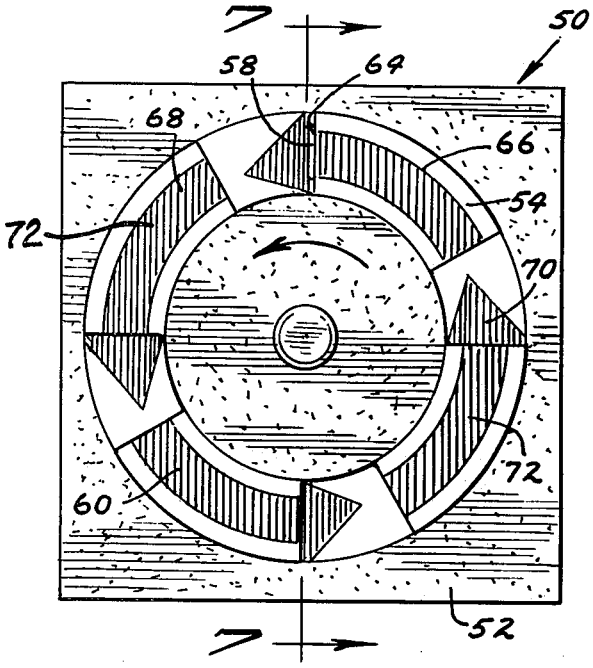
FIG. 5
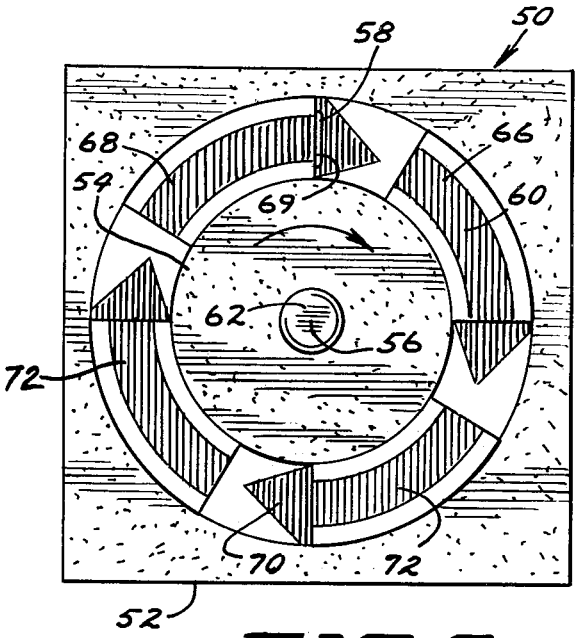
FIG. 6
FIG. 7
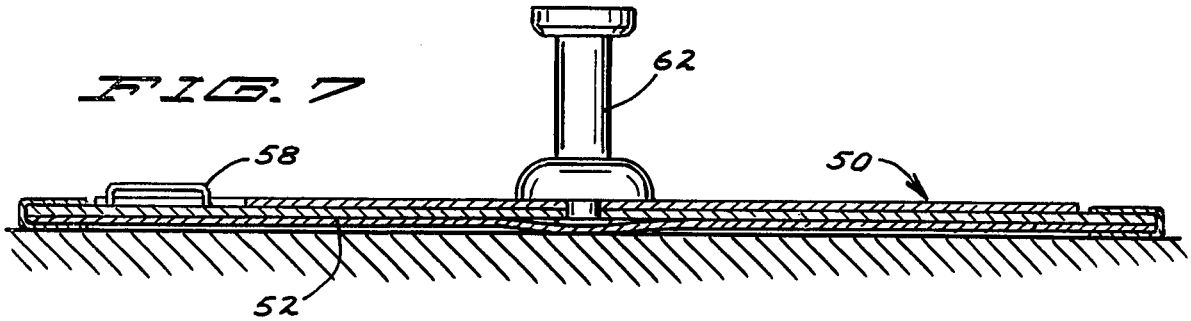
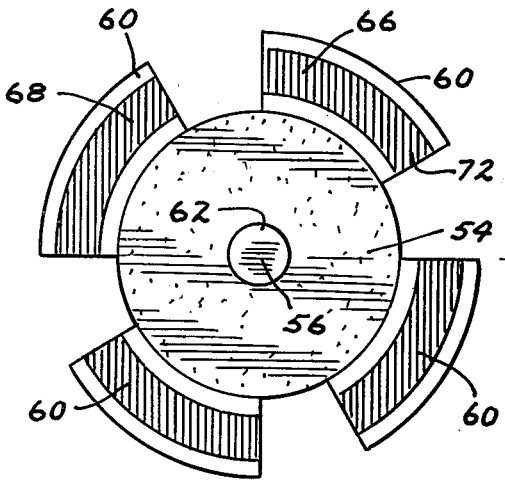
FIG. 8
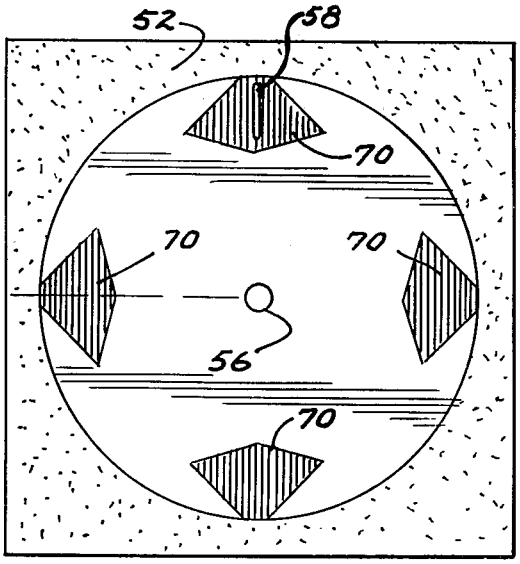
FIG. 9

GAME APPARATUS

BACKGROUND OF THE INVENTION

This invention has relation to board type games where one checker is placed on one square by each of the players as the play moves around the game board. Scoring is based on the ability to line up at least a minimum number of checkers belonging to one team in a horizontal, vertical, or diagonal line.

Chess, checkers and many other games are played on boards made up of horizontally and vertically aligned squares in two alternating colors. For example, see U.S. Pat. No. 1,344,983 to Bruner, granted in June of 1920; and U.S. Pat. No. 2,614,842 to Rice, granted in October of 1952. See also the rules for checkers and chess in such documents as "Rules According to Hoyle".

Other board games have been devised whereby playing pieces of one kind or another can be moved over and along various designated areas on game boards. See, for example, U.S. Pat. No. 2,896,950 to Rosti et al, granted in July of 1959; and U.S. Pat. No. 2,772,885 to Wales, granted in December of 1956.

In U.S. Pat. No. 2,520,207 to Graham, granted in August of 1950, a number of playing pieces are deposited by several players, each in their turn, on a game board to attempt to enclose geometric areas on the board. The enclosure of each such area by a player results in an award of a point to that player. These points are tabulated by placing counters, identifying each player by a particular color, within the areas enclosed. The player with the most counters at the end of the game is declared the winner.

Board games in which a player moves his playing piece over a number of squares or steps in a predetermined path upon the roll of dice, or the spinning of a pointer, are very well known and range from the game of Parcheesi to the game as set out in U.S. Pat. No. 4,053,154 to Niemann, granted in October of 1977.

The first five patents listed above were located during a search of the prior art conducted in 1959. The Niemann patent was obtained as a novelty because applicant's attorney was informed that it contained the longest issue patent claim.

The patent to Graham shows the use of numerous playing pieces which are placed one at a time by the players on a game board and shows the use of counters within a closed geometric figure on the game board to indicate scoring. The applicant takes no position as to how pertinent the other four early patents are to the present invention. The Niemann patent is not believed to be pertinent.

Neither applicant nor those associated with applicant know of any prior art which anticipates the invention claimed herein.

SUMMARY OF THE INVENTION

A game apparatus includes a game board provided with a plurality of mutually contiguous playing squares or domains of substantially equal size, the domains being arranged to form a plurality of mutually perpendicular files and columns and to form two sets of mutually perpendicular diagonal rows of domains. In the form of the invention as shown, the playing squares or domains are formed into an overall square shape containing 20 files and 20 columns, making a total of 400 separate domains. However, the game can be played on a game board wherein the outer edges are defined by playing squares or domains which do not form a square, a rectangle, or any usual geometric shape. There may be considerably more or considerably less than 400 domains involved.

There are four playing positions around the board, and, in the form of the invention described, each of these positions is associated with a game player. As shown, there are two teams of two players each, the players on each team sitting opposite each other. It is possible, however, for two people to satisfactorily play the game, each person placing one playing disc or checker on the game board for each playing position as the turn for that playing position comes up.

The object of the game is to score points. A point is scored each time a player on one of the teams places a checker or playing disc in alignment with other checkers or playing discs belonging to that team in either horizontal, vertical or diagonal direction, and the total in line comes up to at least a predetermined minimum. In the form of the invention described, the minimum for scoring one point is six checkers in line. The game could be played effectively were one point to be awarded for five in line or seven in line or some other number.

Each time a score is made by placing a checker from a particular playing position, a counter indicative of the score is placed on top of the scoring checker, and the direction of play around the four playing positions is reversed. In other words, if the play starts out in clockwise direction around the game board table, as soon as the first score is made, the person next to the scoring position in a counterclockwise direction will make the next play onto the board.

In order to keep track of the direction of play and of the changes in direction of play, a direction indicator is provided. This includes a base having double-faced arrowheads thereon, and an arrow shield rotatably mounted on the base and having at least one segment with a curved arrow shaft thereon. The segment is of such shape and configuration that when it is rotated to a first position with respect to the base, the half of the double-faced arrow together with the curved arrow shaft indicate a clockwise direction; and when placed in a second position with respect to the base, the other half of the dobule-faced arrow and the arrow shaft indicate a counterclockwise direction.

All of the domains in one of the diagonal rows of the game board are observably designated in a distinctive manner to indicate them as "neutral" domains. This designation could be by surface texture (for example, smooth for neutral), by numbers or letters, by braille indicia; but in the form of the invention shown, this designation is by color. The neutral domains are designated by a light brown or beige color as shown. Every third diagonal row is similarly designated.

Another diagonal row of domains immediately contiguous with and parallel to the first neutral diagonal row is observably designated in a first distinctive manner to be distinguishable from the neutral domains. These first distinctive domains could be covered with sandpaper, for example, but in the form of the invention as shown, they are colored pink. Every third row is similarly designated.

All of the domains in a diagonal row immediately contiguous to the neutral diagonal row but at a side thereof opposite the pink diagonal row will be observably designated in a second distinctive manner. For example, these second distinctive domains could have a texture such as that provided by a flat bastard file; but in the form shown, they are colored blue. Every third row is similarly designated.

The playing discs or checkers are each provided on an obverse side thereof with a pink dot or other means of being observably associated with the first distinctive domains; and are provided with a blue dot or other means of being observably associated with the second distinctive domains. Half of the checkers are distinctively designated in a third manner as being for one team and half are distinctively designated in a fourth manner as being for another team. In the form of the invention shown, half of the checkers are black and half are white. A wide latitude can be allowed as to the number of checkers provided each team, but where there are 400 domains, a total of 72 checkers for each team has proved highly satisfactory.

As suggested above, one means of scoring is to award one point when a minimum number of checkers are in line. For example, one point can be allowed for six checkers, two points for seven, three points for eight, etc. A plurality of counters associated with each team are provided, each counter having a digit indicative of a possible score displayed on at least one side thereof. After a checker is positioned to qualify for a score, a counter representing the score is placed on top of that checker, and the direction indicator is reversed to reverse the direction of play around the game board table.

The game can be continued for a specified period of time, or it can continue until one team plays all of its checkers. In one form of scoring, the most points on the counters on the board for one team indicates the winning team.

In order to encourage more immediate interaction between the checkers set down by the two teams, a "starting area" can be provided. As shown, this starting area is in a central portion of the board and consists of four mutually aligned adjacent centered domains sharing a common corner and four pairs of outer domains each contiguous with and extending outwardly from two of the center domains in a cruciform configuration. Other configurations for the starting area will also prove effective. If so desired, all domains inside of the starting area can be designated as neutral, as shown.

To add further interest to the game, four "free" domains can be designated for each team. These domains covered with either black or white "free" "playing discs" cannot be covered by checkers of the opposite team, and already stand in favor of the team whose color they carry. In the interest of fair play, these "free" domains are positioned symmetrically with respect to the outer edge of the game board and with respect to any starting area.

While the game has been described with the neutral rows as diagonal rows, and with the pink and blue rows also extending parallel to all of the neutral rows and lying diagonally across the game board, it is to be understood that the game would operate in the same manner if every third one of the central vertical columns or horizontal files was designated as "neutral" and all of the squares in those columns or files were so colored, with the intervening columns or files being colored pink and blue. The game would, in effect, be exactly the same game except that the outer periphery of the game board, if it still had 20 files and 20 columns would have to be positioned in a diamond configuration to read on this specification and the claims which follow.

This can easily be seen and understood if the domains were constituted as circles rather than squares.

The term "domain" is used herein to designate the playing squares shown and to indicate that they would not have to be square but could be any one of many shapes such as circular or diamond-shaped or simply a spot equidistant from all other spots representing contiguous domains.

In playing the checkers onto the game board, the players or the playing positions will be designated as white/pink, black/pink, white/blue, and black/blue. As the play goes around the board, the player or playing position designated white/pink must deposit his checker with the pink side up and can deposit it anywhere on the playing board except on a domain colored blue or on one of the "free" domains.

The playing position black/pink must deposit the checker with the pink spot up and can place it anywhere except on a blue domain. Similarly, the white/blue player deposits the white checker with the blue spot up anywhere except on a pink domain; and the black/blue player deposits the black checker with the blue spot up anywhere except on a pink domain.

Where a starting area is provided the first checker placed for each playing position can be placed within the starting area.

IN THE DRAWINGS

FIG. 1 is a top plan view of a game board made according to the present invention with a number of playing discs or checkers and counters thereon as they might be distributed in playing a game;

FIG. 2 is a bottom edge view of the game board of FIG. 1 but with other playing pieces and a counter thereon;

FIG. 3 is a bottom edge view of the game board of the invention in stored position;

FIG. 4 is an enlarged view of the two differently colored checkers used to play the game, showing the obverse and the reverse sides of each;

FIG. 5 is a top plan view of a direction indicator used in playing the game of the invention and indicating a counterclockwise direction of play;

FIG. 6 is a top plan view of the indicator of FIG. 5 but indicating a clockwise direction of play;

FIG. 7 is an enlarged vertical sectional view taken on the line 7—7 in FIG. 5;

FIG. 8 is a top plan view of a rotatable arrow shield of the direction indicator; and FIG. 9 is a top plan view of a stationary base of the direction indicator of FIGS. 4–6.

DESCRIPTION OF PREFERRED EMBODIMENT

A game board 10 includes a top surface 12 which is laid out with horizontal and vertical lines to provide a plurality of mutually contiguous playing squares or domains 14. In the form of the invention shown, there are 20 vertical columns 16 each made up of 20 vertically aligned playing squares or domains 14, and there are 20 horizontal files 18 each made up of 20 horizontal playing squares 14.

Each of the squares or domains in a diagonal row 20 extending from the lower lefthand corner of the game board 10 to the upper righthand corner thereof as seen in FIG. 1 is observably designated in a similar manner. In the form of the invention as shown, the domains are visually so designated. These squares or domains in this row 20 are all indicated to be of a neutral color such as light brown or beige. Row 20 is then designated as a neutral row made up of neutral squares or domains 14.

A first distinctively marked diagonal row 22 contiguous with neutral row 20 is made up of squares 14 which are designated as being of a first distinctive color, pink as shown.

A second distinctively marked diagonal row 24 also contiguous with the diagonal neutral row 20, but on a side opposite from row 22 is made up of squares 14 which are designated as being of a second distinctive color, blue as shown.

Adjacent diagonal rows parallel with the original neutral row 20 are alternately designated 20, 22 and 24, and the domains therein are colored "neutral" (beige), pink and blue, respectively.

A starting area 26 is cruciform in shape, and is designated with heavy lines on the face of the game board 10.

As shown, the game is played by two teams of two players each, each team using checkers or playing discs 30 observably designated in a distinctive manner. One team uses checkers designated by a third distinctive "color", black as shown; and is known as the black team. The other team uses playing discs or checkers designated by a fourth distinctive "color", white as shown; and is known as the white team.

Four "free" squares or domains 28 are designated on the face of the game board, two for each team.

Each team is provided with 72 playing discs or checkers 30. Each of the checkers, whether white or black, is distinctively designated on an obverse side to be associated with the domains in first distinctively designated diagonal rows 22, by a pink spot 32 or 36; while a second distinctively colored blue spot 34 or 38 associated with the domains of the second distinctively designated diagonal rows 24 is displayed on the reverse side of each of the checkers.

The diagonal row extending from the lower right-hand corner of the game board to the upper lefthand corner thereof is designated as a diagonal row 40 as are all diagonal rows parallel to it. Diagonal rows 40 each extend at right angles to the diagonal rows 20, 22 and 24; and the domains 14 which make up each diagonal row 40 are colored in a repeating pattern from neutral to pink to blue to neutral.

An exception to this color pattern of domains or playing squares are the squares within the starting area 26 which are designated as neutral and are appropriately colored.

To keep score, counters 42 are provided. Half of the counters 42 are "colored" black and half white. Each counter displays a different digit (from one through eight) on each side thereof.

A direction indicator 50 of the present invention includes a stationary base 52, and a rotatable arrow shield 54 rotatably mounted on the base as at 56. A shield rotation limit bar 58, constituted as a staple through the base 52 in the form of the invention as shown, is situated between two of four outwardly extending shield segments 60 of the shield 54.

A shield handle 62 is integral with the rotatable arrow shield 54 and is for the purpose of rotating the shield from position as seen in FIG. 5, with the staple or limit bar in touch with a lefthand edge surface 64 of a northeast shield segment 66 to position as seen in FIG. 6 with the limit bar 58 against the righthand edge 69 of a northwest segment 68 of the shield 54 as seen in FIGS. 5, 6 and 8.

Four double-face arrowheads 70 are distinctively colored and displayed on the base 52; while four curved arrow shafts 72 are similarly colored, are displayed one on each of the segments 60, and are in alignment with and are narrower than arrowheads 70. The segments 60 themselves are wide enough to entirely block one or the other of the arrowhead halves when the parts are positioned as seen in FIGS. 5 and 6.

METHOD OF PLAY

The game of the invention is adaptable to many rule changes with many interesting results. Set out below is a set of rules and methods, however, which has been found to yield highly satisfactory results in terms of enjoyment, challenge, sustaining of interest, testing perception and memory skills, etc.

The playing positions, along the four sides of the playing board, and the players sitting there can be designated in clockwise order as white/pink; black/pink; white/blue; and black/blue. The player operating from the playing position from which the game is started, say the white/pink, for example, must place a white checker with the pink side up anywhere within the starting area, if the starting area is to be used as such. The next player, assuming the game starts out in a clockwise direction, will be the black/pink player, and that one must place a black checker with the pink side up also within the starting area. The white/blue player and the black/blue player will each, in turn, place their checkers with the blue side up within the starting area.

Each player will continue to put down the proper checker with the proper color uppermost in rotation around the board until one of the players puts down the checker which becomes the sixth one in line either vertically or horizontally or diagonally in either diagonal direction. At this point, a counter representing that team and with the numeral "1" thereon will be placed on top of the scoring checker. The direction of the direction indicator will be reversed, and the next player in counterclockwise direction will then place a checker on the board. Play will continue in this direction until someone scores, at which time the counter will be properly positioned and the direction indicator reversed to once again indicate clockwise direction of play.

The game can continue for a predetermined length of time, or until all of the checkers of one side or the other are positioned on the board. At the close of the game, the team with the largest number of points is indicated by the counters is declared the winner.

The embodiments of the invention in which an exclusive property or privilege is claimed are defined as follows:

1. Game apparatus including a substantially flat game board marked to provide a plurality of mutually adjacent domains of substantially equal size, said domains being arranged to form a plurality of mutually perpendicular files and columns and to form two sets of mutually perpendicular diagonal rows, the rows of each set extending at an acute angle to the files and columns;

all of the domains of one of the longest diagonal rows being observably designated in a distinctive manner to indicate them as neutral domains in a first neutral diagonal row of domains;

all of the domains in a diagonal row immediately contiguous to said neutral row being observably designated in a distinctive manner to be distinguishable from the neutral domains and to indicate them as first distinctive domains in a first distinctive diagonal row of domains;

all of the domains in a diagonal row immediately contiguous to said neutral diagonal row of domains on a side thereof opposite said first distinctive diagonal row being observably designated in a distinctive manner to be distinguishable from the neutral domains and from the first distinctive domains and to indicate them as second distinctive domains in a second distinctive diagonal row of domains;

all of the domains in each diagonal row of domains parallel to said first neutral diagonal row of domains being observably designated to be part of a neutral, first distinctive or second distinctive row and each such row being distinguishably different from each row contiguous to it;

a plurality of two-sided checkers to be placed on the game board in playing a game with the apparatus;

each checker being sized to be positioned within the area of one domain in a non-overlapping relation to checkers placed in immediate contiguous domains;

each checker being distinctively designated on an obverse side thereof to be observably associated with the first distinctive domains, and being distinctively designated on a reverse side thereof to be observably associated with the second distinctive domains; and half of the checkers being observably designated to be used by a first team playing the game and half of the checkers being observably designated to be used by a second such team.

2. The game apparatus of claim 1 and a plurality of two-sided counters, each sized to be placed on top of one of the checkers on the game board during the playing of the game;

each such counter having indicia on at least one side thereof indicative of a score which can be achieved by a player upon the placing of a topped checker on the board.

3. The game apparatus of claim 2;

wherein some of said counters are observably designated to be used by one of said teams and some designated to be used by the other team; and wherein counters from each team display indicia including each of the digits 1 through 8, inclusive.

4. The game apparatus of claim 1, further including a direction indicator for use therewith, said indicator including:

a stationary base having at least one double-face arrowhead displayed thereon;

an arrow shield rotatably mounted on said base; in alignment with said arrowhead and including a first shield end and a second shield end each terminating on a radial line passing through the axis of rotation of said shield with respect to said base;

said shield having at least one curved arrow shaft displayed thereon, said shaft having a thickness of less than the maximum dimension of the arrowhead;

means for rotating said shield with respect to said base; and means for limiting rotational movement of said shield with respect to said base in a first direction to position said first segment end to shield a first half of said double-face arrowhead from view to cause the visible part of the arrowhead and the curved arrow shaft to indicate a clockwise direction for game player movement, and for limiting rotational movement of said shield in the opposite direction to position said second segment end to shield a second half of said double-face arrowhead from view to cause the visible part of the arrowhead and the curved arrow to indicate a color counterclockwise direction of game play.

5. The game apparatus of claim 4;

wherein there are four double-face arrowheads displayed on the stationary base of the direction indicator, all situated in equidistant relation around an arrowhead circle concentric with the axis of rotation of said shield with respect to said base;

wherein there are four segments each with a curved arrow shaft thereon, said shafts all bring aligned and concentric with said arrowhead circle.

6. The game apparatus of claim 1:

wherein a "starting area" is designated as a plurality of contiguous domains located in a central portion of the game board.

7. The game apparatus of claim 6:

wherein the "starting area" is located at the center of the board and consists of four mutually aligned adjacent center domains sharing a common corner and four pairs of outer domains each contiguous with and extending outwardly from two of the center domains in a cruciform configuration.

8. The game apparatus of claim 7 wherein two spaced apart sets of two adjacent domains are designated as "free" domains for each of two separate teams.

9. The game apparatus of claim 8 wherein the domains are displayed on the game board in twenty contiguous columns and twenty contiguous files.

10. The game apparatus of claim 1 and a plurality of two-sided counters each sized to be placed on top of one of the checkers on the game board during the playing of the game;

each such counter having indicia on at least one side thereof indicative of a score which can be achieved by a player upon the placing of a topped checker on the board.

11. The game apparatus of claim 10;

wherein some of said counters are observably designated to be used by one of said teams and some designated to be used by the other team; and wherein counters for each team display indicia including each of the digits one through 8, inclusive.

* * * * *